US008487725B2

(12) United States Patent
Takaya et al.

(10) Patent No.: US 8,487,725 B2
(45) Date of Patent: Jul. 16, 2013

(54) ELECTROMAGNETIC CONTACT DEVICE

(75) Inventors: Kouetsu Takaya, Kounosu (JP); Koji Okubo, Kounosu (JP); Yasuhiro Naka, Kounosu (JP); Kenji Suzuki, Kounosu (JP)

(73) Assignee: Fuji Electric Fa Components & Systems Co., Ltd., Tokyo (JP)

( * ) Notice: Subject to any disclaimer, the term of this patent is extended or adjusted under 35 U.S.C. 154(b) by 15 days.

(21) Appl. No.: 13/381,536

(22) PCT Filed: Jun. 14, 2010

(86) PCT No.: PCT/JP2010/003939

§ 371 (c)(1),
(2), (4) Date: Feb. 6, 2012

(87) PCT Pub. No.: WO2011/021337

PCT Pub. Date: Feb. 24, 2011

(65) Prior Publication Data

US 2012/0139672 A1 Jun. 7, 2012

(30) Foreign Application Priority Data

Aug. 20, 2009 (JP) ..... 2009-190590

(51) Int. Cl.
*H01H 9/02* (2006.01)

(52) U.S. Cl.
USPC ..... 335/202; 335/201

(58) Field of Classification Search
USPC ..... 335/6, 201, 202; 200/306; 218/34, 218/35, 52, 149–151, 155–158
See application file for complete search history.

(56) References Cited

U.S. PATENT DOCUMENTS

| | | | | |
|---|---|---|---|---|
| 6,388,867 | B1 * | 5/2002 | Rakus et al. | 361/605 |
| 6,670,872 | B2 * | 12/2003 | Kurzmann | 335/201 |
| 2012/0133460 | A1 * | 5/2012 | Okubo et al. | 335/132 |

FOREIGN PATENT DOCUMENTS

| | | |
|---|---|---|
| JP | 11-167854 | 6/1999 |
| JP | 2000-57921 | 2/2000 |
| JP | 2005-332588 | 12/2005 |
| JP | 2008-47419 | 2/2008 |

* cited by examiner

*Primary Examiner* — Bernard Rojas
(74) *Attorney, Agent, or Firm* — Manabu Kanesaka

(57) ABSTRACT

An extinction cover (5) is mounted on a case (4) thereby sealing an extinction chamber (S). This extinction cover has an engaging-force-increased portion (5*c*1) which strengthens the force of engagement with the case, and an engaging-force-decreased portion (5*c*2) which weakens the force of engagement with the case. In response to an increase in internal pressure in the extinction chamber due to arc gas generation, the engaging-force-decreased portion establishes disengagement of the case and provides a gap (27) with the case, for linking the extinction chamber to external air, and the engaging-force-increased portion maintains engagement with the case.

6 Claims, 13 Drawing Sheets

ELECTROMAGNETIC CONTACT DEVICE

RELATED APPLICATIONS

The present application is National Phase of International Application No. PCT/JP2010/003939 filed Jun. 14, 2010, and claims priority from Japanese Application No. 2009-190590, filed Aug. 20, 2009.

TECHNICAL FIELD

The present invention relates to an electromagnetic contact device, and in particular related to a structure in which an extinction cover is held.

BACKGROUND ART

The electromagnetic contact device 1 shown in FIG. 13 comprises a lower case 3 and upper case 4, formed from a synthetic resin material having insulating properties. In the upper case 4 are fixed terminal portions 10*a* to 10*d* each having contact points and a coil terminal 11 of an electromagnet, and in addition, a contact portion comprising movable contact points and fixed contact points is accommodated in an extinction chamber within the upper case 4. The lower case 3 accommodates an electromagnet and a driving lever which drive the contact portion. Further, within the upper case 4 are mounted an extinction cover 5 which covers the contact point portion in the extinction chamber, and a terminal cover 6 which covers the terminal portions 10*a* to 10*d*, each having contact points, and the coil terminal 11 of the electromagnet.

Here, when an abnormally large current flows in the contact portion of the electromagnetic contact device 1 due to a short-circuit accident or similar, there is the concern that the extinction cover 5 may fly off due to the rise in internal pressure in the extinction chamber due to the arc gas which is generated. Hence, electromagnetic contact devices are known in which, by providing a gas escape hole in a portion of the extinction cover and allowing the generated arc gas to be released to the outside from the gas escape hole, the rise in internal pressure of the extinction chamber is suppressed, and flying-off of the extinction cover 5 is prevented (see for example Patent Reference 1).

Patent Reference 1: Japanese Patent Laid-open No. 2005-332588

DISCLOSURE OF THE INVENTION

However, if a gas escape hole is provided in the extinction cover as in Patent Reference 1, there is the concern that fine dust may intrude into the movable contact points and fixed contact points of the contact portion, and so there is the problem of the reliability of contact of contact points.

Hence this invention has been made based on the above unresolved problem of examples of the prior art, and has an object of providing an electromagnetic contact device which prevents intrusion of fine dust by employing a sealed structure and increases the contact reliability of the contact point portion, as well as preventing of the flying-off of the extinction cover even when arc gas is generated, and completing gas escape.

In order to achieve the above object, the electromagnetic contact device of one embodiment has a case accommodating in an extinction chamber a contact point portion having a movable contact point and a fixed contact point; and an extinction cover covering the extinction chamber and mated with and mounted on the case. The extinction cover is configured to seal the extinction chamber and to be mounted on the case, and has an engaging-force-increased portion which strengthens the force of engaging with the case, and an engaging-force-decreased portion which weakens the force of engaging with the case. In response to an increase in internal pressure in the extinction chamber due to arc gas generation, the engaging-force-decreased portion disengages the case and provides a gap with respect to the case linking the extinction chamber to external air; and the engaging-force-increased portion maintains engagement with the case.

By means of the electromagnetic contact device of this embodiment, in the case of normal operation, a gas escape hole which communicates between the extinction chamber and the outside is not provided, fine dusts will not intrude into the extinction chamber, and an erroneous contact point operation of the contact point portion can be reliably prevented.

Further, when the internal pressure of the extinction chamber rises excessively due to arc gas, the engagement of the engaging-force-decreased portion of the extinction cover with the case is disengaged before the engagement of the engaging-force-increased portion, and a gap which serves as a gas escape hole is formed, so that by reducing the internal pressure in the extinction chamber, flying-off of the extinction cover can be reliably prevented.

Further, in the electromagnetic contact device of one embodiment, the engaging-force-increased portion and engaging-force-decreased portion has an engaging hook portion which is provided on one of the extinction cover and the case, and an engaging hole, which is provided on the other one of the extinction cover and the case, and which engages with the hook portion.

By means of the electromagnetic contact device of this embodiment, by changing the number of engaging hook portions and engaging holes, an engaging-force-increased portion and an engaging-force-decreased portion can easily be formed.

Further, in the electromagnetic contact device of one embodiment, the engaging-force-increased portion and engaging-force-decreased portion are provided at positions in opposing corners of the extinction cover, and the engaging-force-increased portion is provided with a rotational engaging portion conjoined with the case, which rotates the engaging-force-decreased portion disengaged from the case by using the engaging-force-increased portion as a support point.

By means of the electromagnetic contact device of this embodiment, when the internal pressure of the extinction chamber rises excessively due to arc gas, the rotational engaging portion provided on the engaging-force-increased portion causes the extinction cover to rotate, so that the extinction cover is not damaged, and component costs can be reduced.

Further, in the electromagnetic contact device of one embodiment, the engaging-force-decreased portion comprises a rotation-restricting hook portion provided on one of the extinction cover or the case, and a rotation-restricting engaging hole provided on the other of the extinction cover or the case to engage with the rotation-restricting hook portion when the extinction cover disengaged from the case rotates by a prescribed amount.

By means of the electromagnetic contact device of this embodiment, when the internal pressure of the extinction chamber rises excessively due to the arc gas, and when the engaging-force-decreased portion of the extinction cover rotates by a prescribed amount, the rotation-restricting hook portion and the rotation-restricting engaging hole are engaged, so that the extinction cover is not damaged, and component costs can be reduced.

By means of an electromagnetic contact device of this invention, in the case of normal operation, a gas escape hole which communicates between the extinction chamber and the outside is not provided, fine dust does not intrude into the extinction chamber, and erroneous contact point operation of the contact point portion can be reliably prevented, so that contact reliability of the contact point portion can be heightened.

Further, when the internal pressure of the extinction chamber rises excessively due to arc gas, the engagement of the engaging-force-decreased portion of the extinction cover with the case is disengaged before the engagement of the engaging-force-increased portion, and a gap which serves as a gas escape hole is formed, so that by reducing the internal pressure in the extinction chamber, flying-off of the extinction cover can be reliably prevented.

BEST MODE FOR CARRYING OUT THE INVENTION

Figure 13:
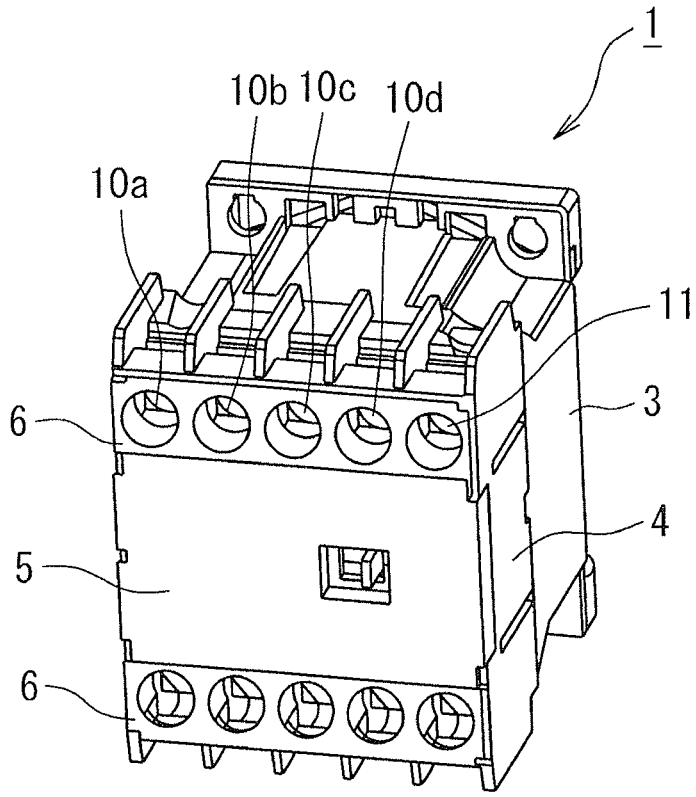
Fig. 13 Prior Art
FIG. 13 is a perspective view showing the outer appearance of an electromagnetic contact device.

Below, examples for implementing the invention (hereafter called embodiments) are explained in detail, referring to the drawings. Constituent components which are the same as in the configuration shown in FIG. 13 are assigned with the same symbols, and explanations are omitted.

First Embodiment

FIG. 1 to FIG. 7 show structures of the upper case 4 and extinction cover 5 of a first embodiment of an electromagnetic contact device.

Figure 1:
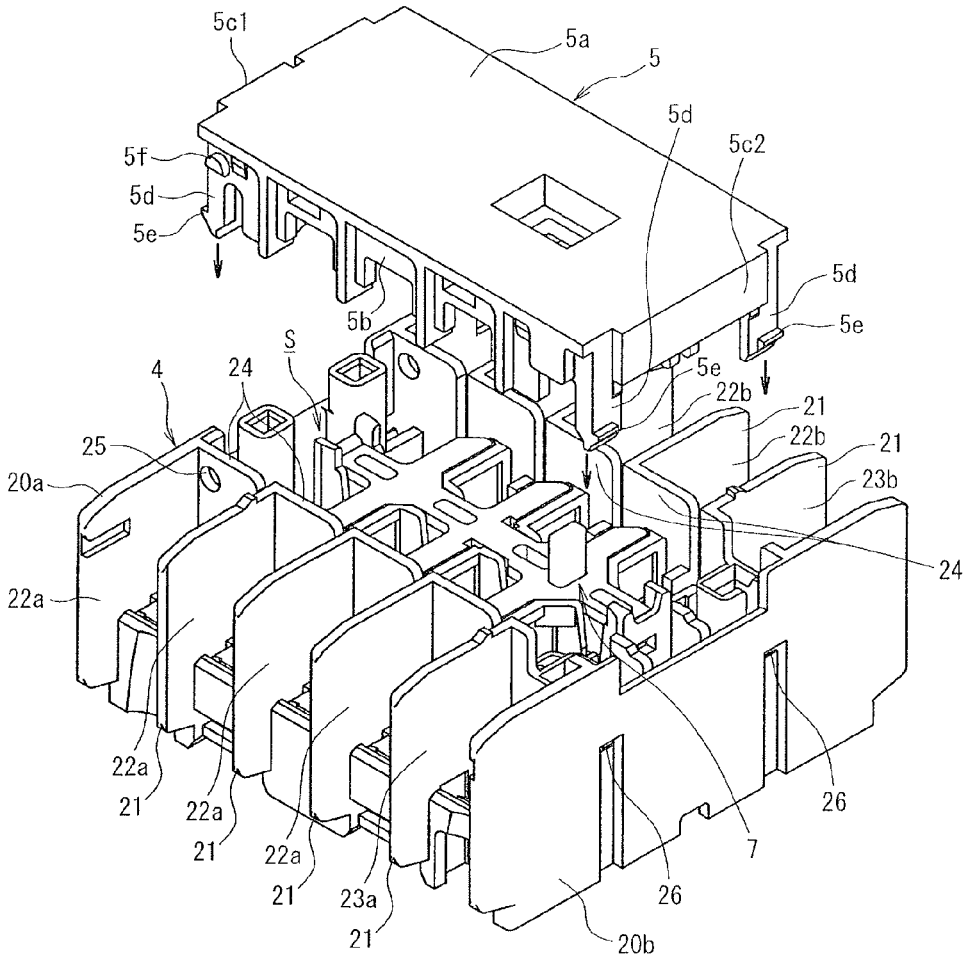
FIG. 1 is an exploded perspective view showing the structure of an upper case and an extinction cover of a first embodiment of an electromagnetic contact device of the invention.
Figure 2:
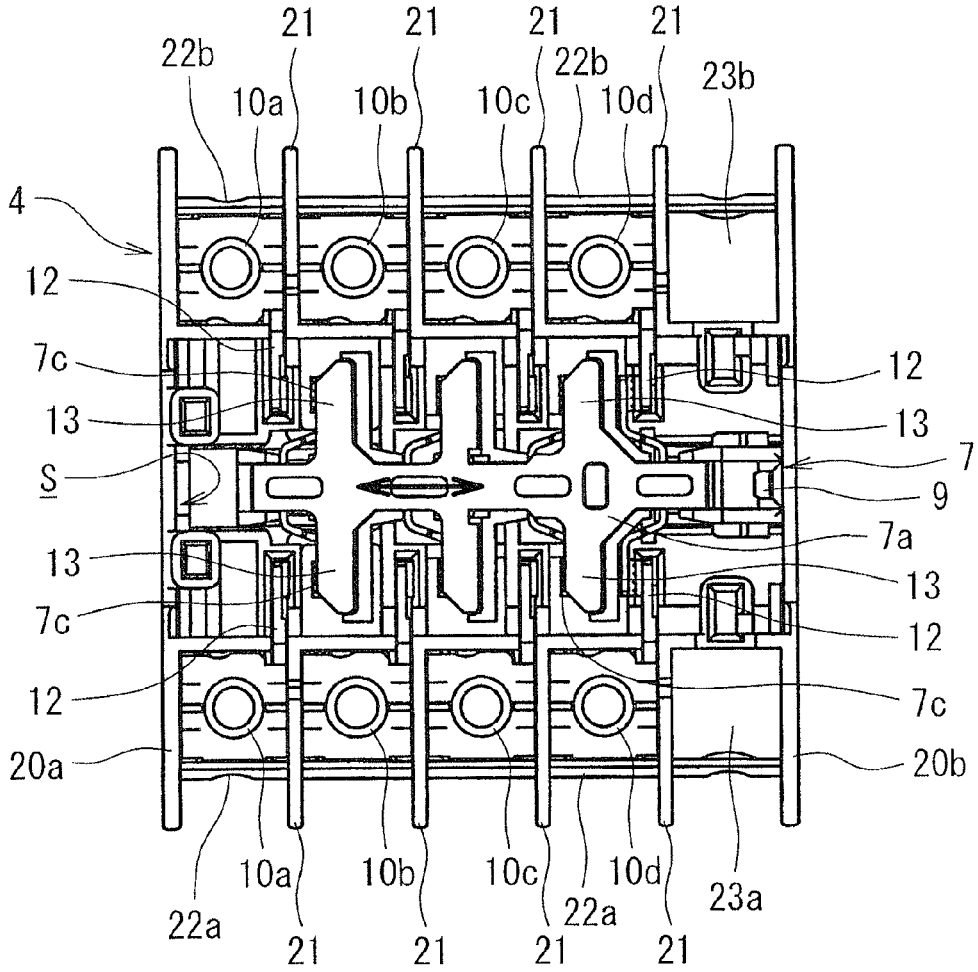
FIG. 2 shows the internal structure of the upper case of the invention.

As shown in FIG. 1 and FIG. 2, in the upper case 4, a plurality of main circuit terminal chambers 22*a* and a coil terminal chamber 23*a* on the lower side, and main circuit terminal chambers 22*b* and a coil terminal chamber 23*b* on the upper side, are provided with the rear face sides mutually opposing to each other by means of a pair of case outer walls 20*a*, 20*b* and a plurality of case partition walls 21 partitioning this pair of case outer walls 20*a*, 20*b* in parallel; by providing a plurality of case inner walls 24 between the lower-side terminal chambers 22*a*, 23*a* and the upper-side terminal chambers 22*b*, 23*b*, an extinction chamber S is formed, and a contact point portion 7 is accommodated in this extinction chamber. And, an extinction cover 5 covering the extinction chamber S is mounted on the upper portion of the upper case 4.

The contact point portion 7 comprises terminal portions 10*a* to 10*d*, each having contact points arranged in the lower-side main circuit terminal chambers 22*a* and upper-side main circuit terminal chambers 22*b*; a movable contact point support 7*a*, arranged in the extinction chamber S; and a return spring, arranged on one end in the length direction of this movable contact point support 7*a* (the left-side end in FIG. 2), and which urges the movable contact point support 7*a* to the other-end side (the right side in FIG. 2).

In the terminal portions 10*a* to 10*d* each having contact points are provided contact point pieces 12 protruding toward the movable contact point support 7*a*; and on one of the side surfaces (the right-side surfaces in FIG. 2) of the tips of the contact point pieces 12 of the terminal portions 10*a*, 10*b* are formed normally-open fixed contact points. Further, normally-closed contact points are formed on the other-side surface (the left-side surface in FIG. 2) of the tips of the contact point pieces 12 of the terminal portions 10*c*, 10*d*.

The movable contact point support 7*a* is a member made of a synthetic resin and extending along the direction of arrangement in a row of the terminal portions 10*a* to 10*d* each having contact points; a plurality of support partition walls 13 is formed maintaining a prescribed interval in the length direction, and movable contact points 7*c* are supported between these support partition walls 13.

And, movable contact points 7*c* supported by prescribed support partition walls 13 are opposed to normally-open fixed contact points of the terminal portions 10*a*, 10*b*. Further, movable contact points 7*c* supported by other support partition walls 13 contact normally-closed contact points of the terminal portions 10*c*, 10*d*.

And, the other-side end in the length direction of the movable contact point support 7*a* is conjoined, via a driving lever, with an electromagnet (not shown) accommodated in the lower case 3; when an electromagnetic coil comprised by the electromagnet enters an excited state, the movable contact point support 7*a* moves to the left side in FIG. 2 against the return spring, and the movable contact points 7*c* supported by prescribed support partition walls 13 move toward the normally-open fixed contact points of the terminal portions 10*a*, 10*b*, and moreover, the movable contact points 7*c* supported by the other support partition walls 13 separate from the normally-closed fixed contact points of the terminal portions 10*c*, 10*d*.

Figure 3:
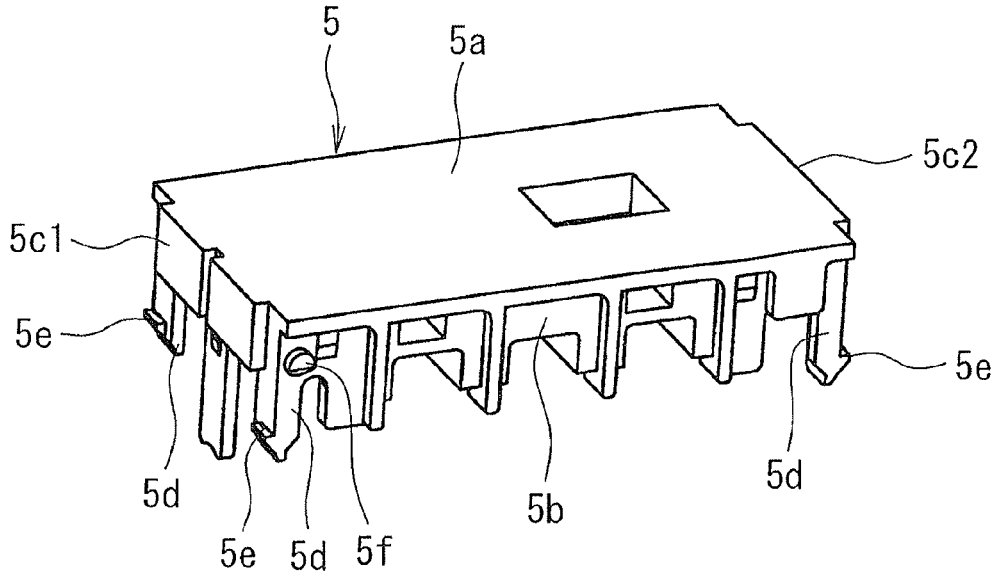
FIG. 3 is a perspective view showing the structure of the extinction cover of the first embodiment of the invention.

As shown in FIG. 1 and FIG. 3, the extinction cover 5 comprises a rectangular-shape cover body 5*a*, which is on the front side in the orientation for installation on the electromagnetic contact device 1; a pair of long-edge wall portions 5*b* formed in mutual opposition from the long-edge side rims of the cover body 5*a*; a pair of short-edge wall portions 5*c*1, 5*c*2 formed to mutually oppose from the short-edge side rims of the cover body 5*a*; pairs of engaging leg portions 5*d* formed at both ends of the short-edge wall portions 5*c*1, 5*c*2 in proximity to the long-edge wall portions 5*b*; hook portions 5*e* formed at the tips of each of the engaging leg portions 5*d*; and a pair of bosses 5*f* formed protruding from positions on each of the long-edge wall portions 5*b* in proximity to one of the short-edge wall portions 5*c*1.

Here, as shown in FIG. 1, in the case inner wall 24 in proximity to one of the case outer walls 20*a* of the upper case 4 are formed a pair of boss holes 25 which respectively mate with the pair of bosses 5*f* of the extinction cover 5 described above.

Figure 5:
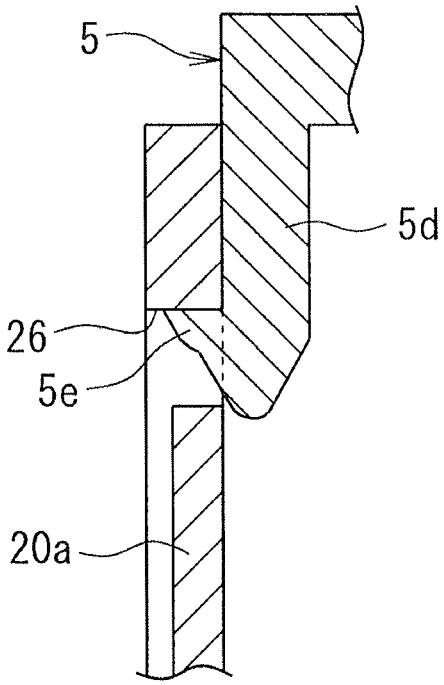
FIG. 5 is a view thereof taken along line A-A in FIG. 4.
Figure 6:
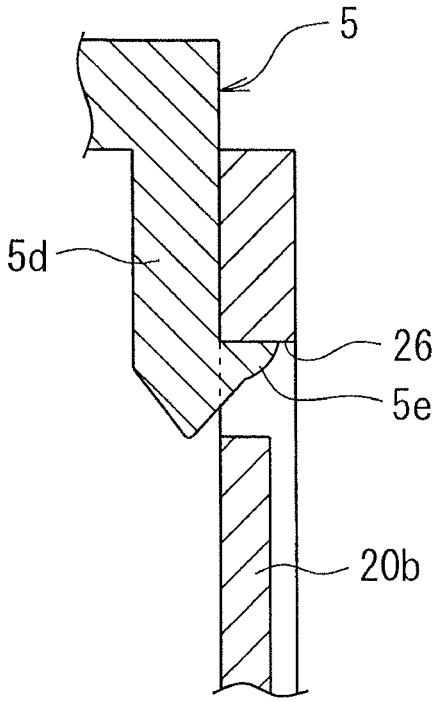
FIG. 6 is a view thereof taken along line B-B in FIG. 4.

Further, as shown in FIG. 5 and FIG. 6, in the pair of case outer walls 20*a*, 20*b* of the upper case 4 are formed engaging holes 26, which engage with the hook portions 5*e* of the pair of engaging leg portions 5*d*, pairs of which are formed in each of the sides of the pair of short-edge wall portions 5*c*1, 5*c*2 of the extinction cover 5.

Figure 4:
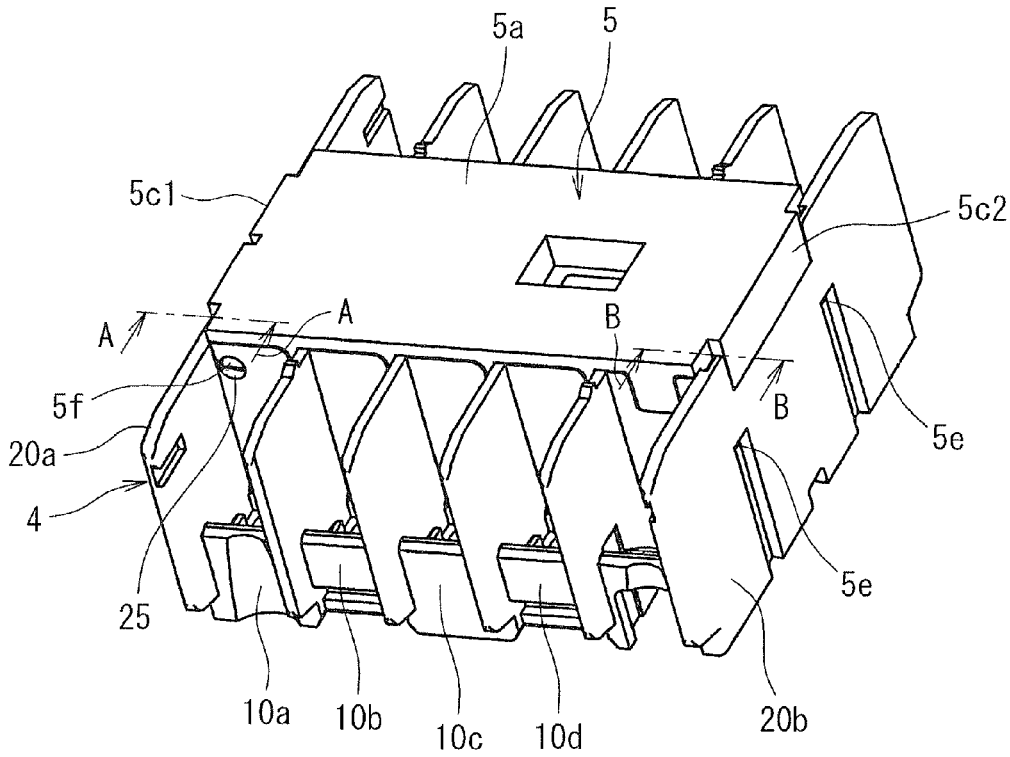
FIG. 4 is a perspective view showing a state in which the extinction cover is mounted on the upper case in the first embodiment.

And, the extinction cover 5 is mated in the direction of the arrow of FIG. 1 toward the extinction chamber S of the upper case 4. At this time, the pair of long-edge wall portions 5*b* slides against the case inner wall 24 of the upper case 4 and enters into the extinction chamber S, and the engaging leg portions 5*d*, while undergoing elastic deformation, slide against the inner faces of the pair of case outer walls 20*a*, 20*b* of the upper case 4, and the hook portions 5*e* on the tips engage with the respective engaging holes 26, while the pair of bosses 5*f* formed on the sides of the short-end wall portions 5*c*1 mates with the pair of boss holes 25 formed in the case inner wall 24, to assume a state in which the lower-end faces of the pair of short-edge wall portions 5*c*1, 5*c*2 abut the upper-end faces of the pair of case outer walls 20*a*, 20*b* of the upper case 4. By this means, as shown in FIG. 4, the extinction cover 5 is mounted on the upper case 4 in a state in which the extinction chamber S is sealed.

The upper case 4 corresponds to the case of this invention; the hook portion 5*e*, engaging hole 26, boss 5*f*, and boss hole 25 which engage one short-edge wall portion 5*c*1 and one case outer wall 20*a*, correspond to the engaging-force-increased portion of this invention; and the hook portion 5*e* and engaging hole 26 which engage the other short-edge wall portion 5*c*2 and the other case outer wall 20*b* correspond to the engaging-force-decreased portion of this invention.

In the electromagnetic contact device 1 comprising the upper case 4 and extinction cover 5 with the above configuration, an anomalous large current flows in the contact point portion 7 due to a short-circuit accident or similar, and the generated arc gas caused an excessive rise in the internal pressure in the extinction chamber S, so that the extinction cover 5 attempts to dissociate and rise up from the upper case 4.

In the extinction cover 5 of this embodiment, a structure is employed in which, on the side of one short-edge wall portion 5*c*1, hook portions 5*e* of the pair of engaging leg portions 5*d* engage with the engaging holes 26 in one of the case outer walls 20*a*, and moreover the pair of bosses 5*f* mates with the pair of boss holes 25 in the case inner wall 24; and on the side of the other short-edge wall portion 5*c*2, hook portions 5*e* of the pair of engaging leg portions 5*d* engage with the engaging holes 26 of the other case outer wall 20*b*, so that the latching force with the upper case 4 on the side of the other short-edge wall portion 5*c*2 is weaker than the latching force with the upper case 4 on the side of the one short-edge wall portion 5*c*1.

Figure 7:
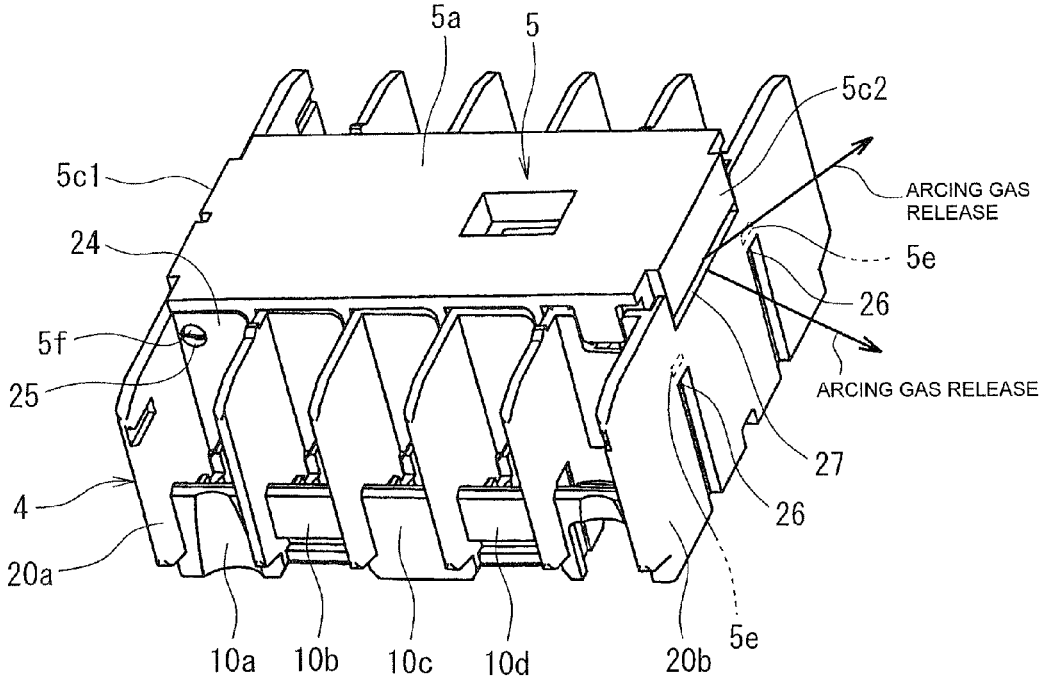
FIG. 7 shows a state in which the internal pressure in the extinction chamber has risen in the first embodiment.

For this reason, as shown in FIG. 7, when the internal pressure of the extinction chamber S rises excessively, the engaged state between the hook portions 5*e* on the side of the other short-edge wall portion 5*c*2 of the extinction cover 5, before the side of the one short-edge wall portion 5*c*1, and the engaging holes 26 is disengaged, and the side of the other short-edge wall portion 5*c*2 rises up by rotating about the bosses 5*f* mated with the boss holes 25.

When the other short-edge wall portion 5*c*2 rises up in this way, a gap 27 is formed between the lower-end face of the other short-edge wall portion 5*c*2 and the upper-end face of the other case outer wall 20*b*, and this gap 27 serves as a gas escape hole so that arc gas within the extinction chamber S is released to the outside, the internal pressure of the extinction chamber S is reduced, and flying-off of the extinction cover 5 is prevented.

Hence in the electromagnetic contact device 1 comprising an upper case 4 and extinction cover 5 of this embodiment, in the case of normal operation, a gas escape hole which communicates between the extinction chamber S and the outside is not provided, fine dust does not intrude into the extinction chamber S which is a sealed space, and erroneous contact point operation of the contact point portion 7 can be reliably prevented, so that the contact reliability of the contact point portion 7 can be heightened.

Further, the extinction cover 5 of this embodiment is mounted on the upper case 4 with a strong latching force and a with weak latching force provided, so that when the internal pressure of the extinction chamber S rises excessively due to arc gas, the engagement state with the weak latching force becomes disengaged first and a gap 27 serving as a gas escape hole is formed, and by reducing the internal pressure of the extinction chamber S, flying-off of the extinction cover 5 can be reliably prevented.

Further, the extinction cover 5 of this embodiment has a structure such that, by rotation about the bosses 5*f*, the other short-edge wall portion 5*c*2 rises up slightly to an extent sufficient to provide a gap 27 as a gas escape hole, and the extinction cover 5 is not damaged, so that the component costs can be reduced.

Second Embodiment

Next, FIG. 8 to FIG. 12 show the structure of the upper case 4 and the extinction cover 5 in a second embodiment of an electromagnetic contact device. Constituent elements which are the same as those shown in FIG. 1 to FIG. 7 are assigned the same symbols, and explanations are omitted.

Figure 8:
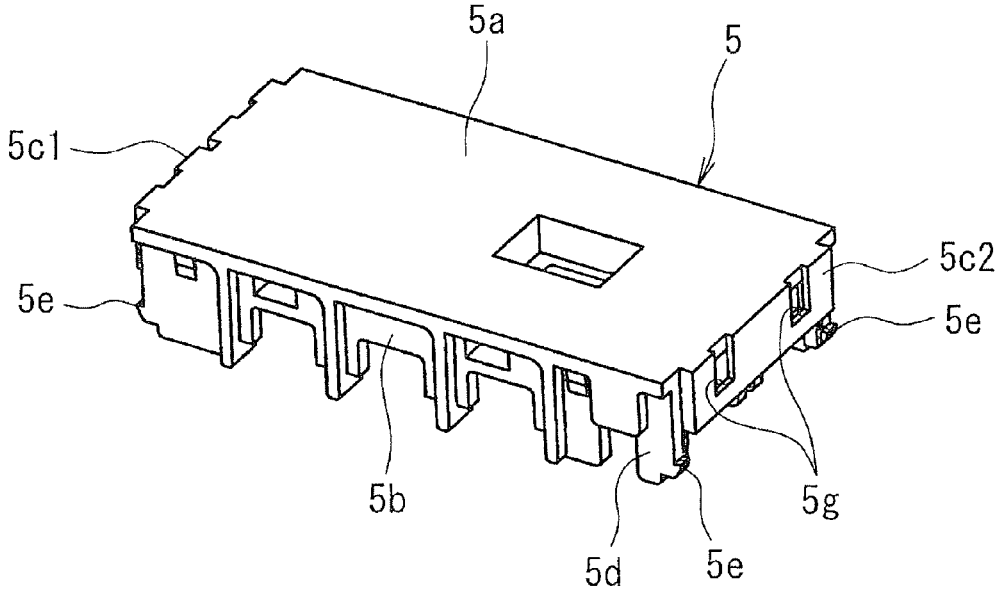
FIG. 8 is a perspective view showing the structure of the extinction cover in a second embodiment of the invention.
Figure 9:
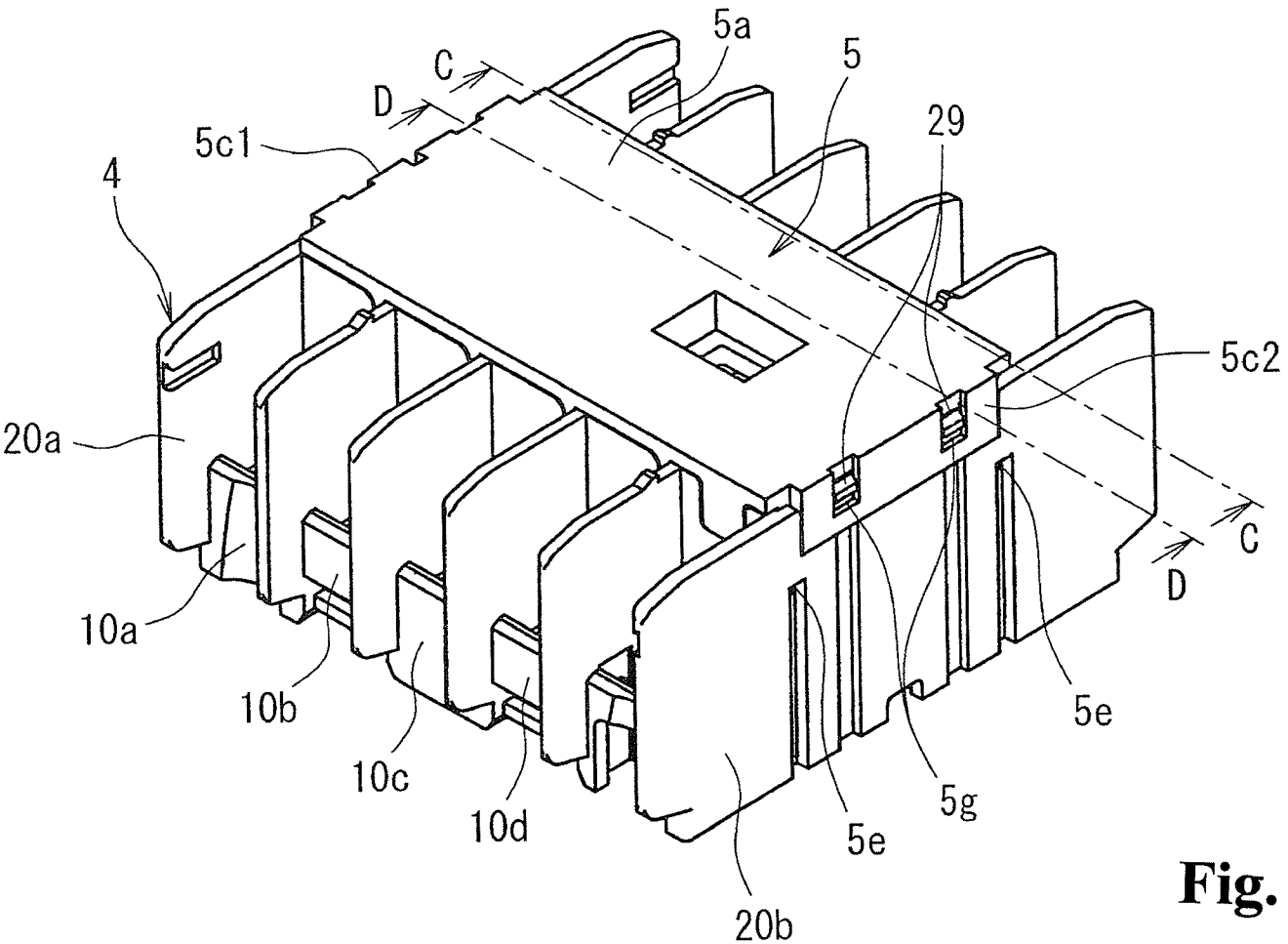
FIG. 9 shows a state in which the extinction cover is mounted on the upper case in the second embodiment.
Figure 10:
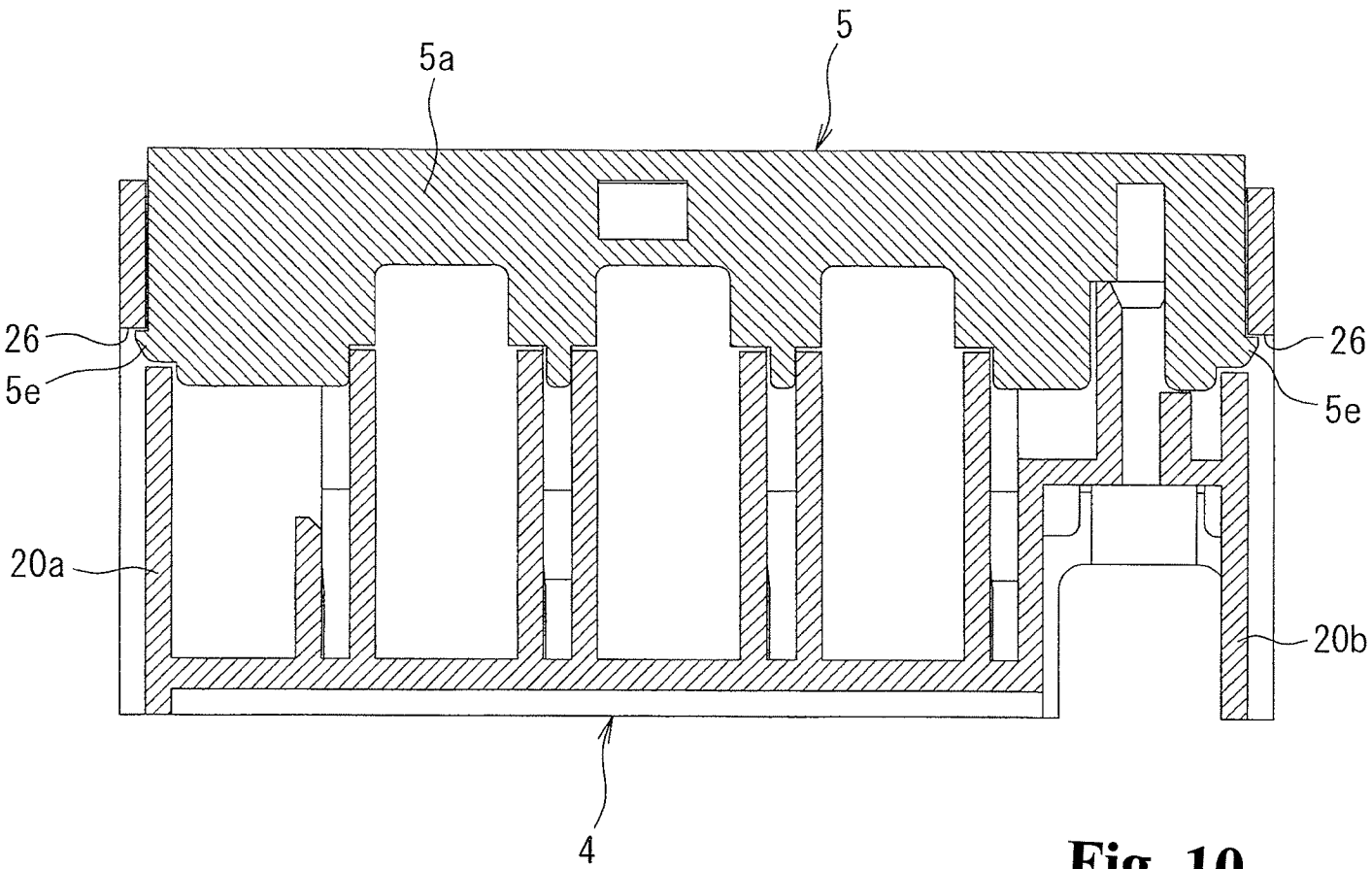
FIG. 10 is the view thereof taken along line C-C in FIG. 9.
Figure 11:
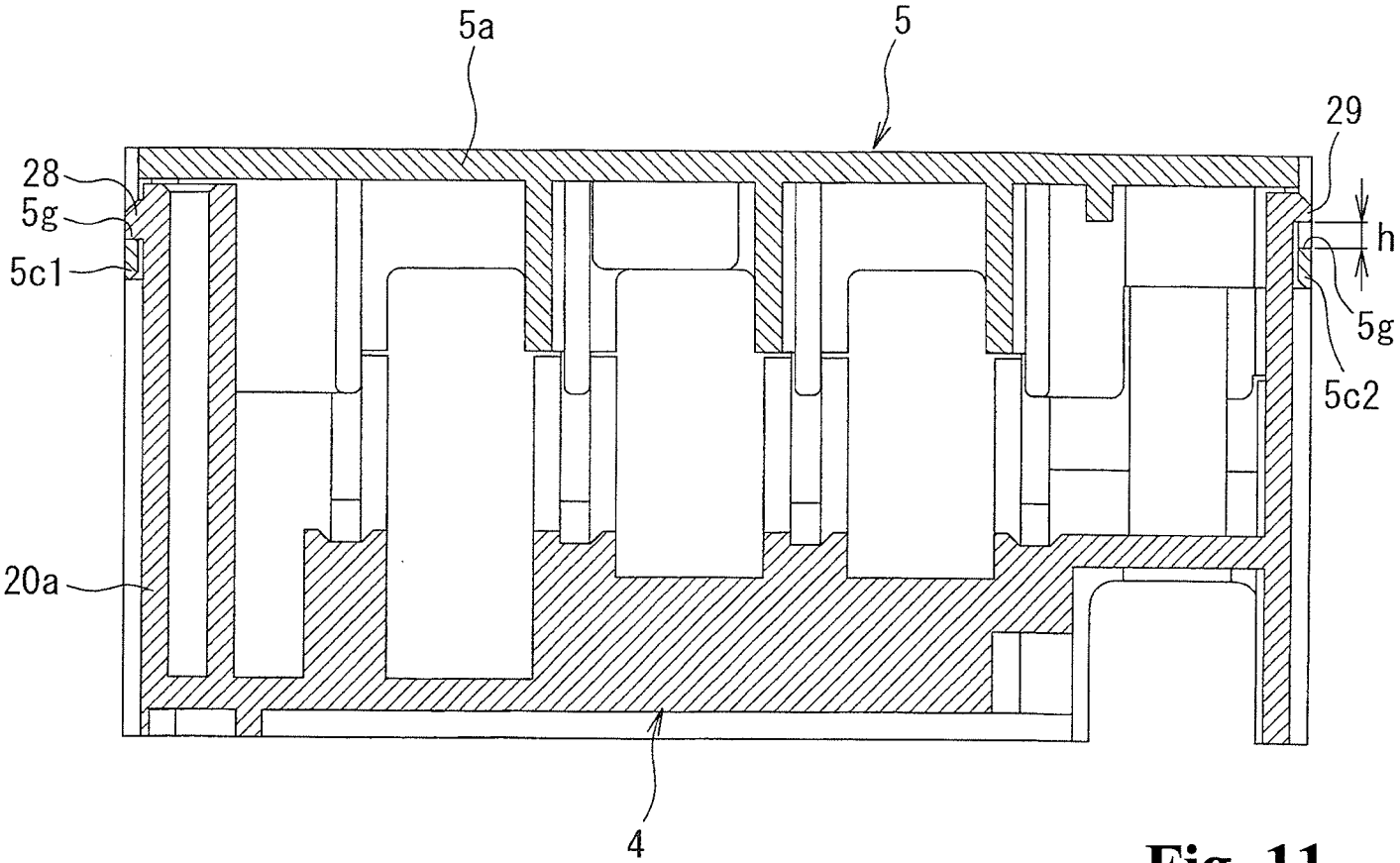
FIG. 11 is the view thereof taken along line D-D in FIG. 10.

As shown in FIG. 8 to FIG. 10, a pair of hook portions 5*e* is formed at both ends of each of the pair of short-edge wall portions 5*c*1, 5*c*2 forming the extinction cover 5 of this embodiment in proximity to the long-edge wall portions 5*b*, and as shown in FIG. 9 and FIG. 11, a pair of engaging holes 5*g* is formed between the pair of hook portions 5*e*.

Further, as shown in FIG. 10, a pair of engaging holes 26 which engages with the pair of hook portions 5*e* of the extinction cover 5 is formed on the pair of case outer walls 20*a*, 20*b* forming the upper case 4 of the embodiment. Further, as shown in FIG. 11, a pair of first case-side hook portions 28, which engages with the pair of engaging holes 5*g* in one short-edge wall portion 5*c*1, is formed on the upper-end portion of one case outer wall 20*a*, positioned between the pair of engaging holes 26. And, as shown in FIG. 9 and FIG. 11, a pair of second case-side hook portions 29, which enters into the pair of engaging holes 5*g* in the other short-edge wall portion 5*c*2, is formed on the upper-end portion of the other case outer wall 20*b*, positioned between the pair of engaging holes 26.

Then, the extinction cover 5 of this embodiment is directed toward the extinction chamber S of the upper case 4 and mated. At this time, the pair of long-edge wall portions 5*b* slide against the case inner walls 24 of the upper case 4 and enter into the extinction chamber S, and the hook portions 5*e* formed on the pair of short-edge wall portions 5*c*1, 5*c*2 of the case cover 5 are engaged with all the engaging holes 26 in the pair of case outer walls 20*a*, 20*b*. And, the pair of first case-side hook portions 28 formed in one case outer wall 20*a* of the upper case 4 is engaged with one pair of engaging holes 5*g* of the one short-side wall portion 5*c*1. Here, as shown in FIG. 11, the pair of second case-side hook portions 29 formed on the other case outer wall 20*b* of the upper case 4 is arranged in a state with a gap of prescribed height h provided with the lower face of the pair of engaging holes 5*g* of the other short-edge wall portion 5*c*2. By this means, as shown in FIG. 9, the extinction cover 5 is mounted on the upper case 4 in a state in which the extinction chamber S is sealed.

The upper case 4 corresponds to the case of this invention; the hook portions 5*e*, engaging hole 26, first case-side hook portions 28, and engaging holes 5*g* which engage one short-edge wall portion 5*c*1 and one case outer wall 20*a* correspond to the engaging-force-increased portion of this invention; the hook portions 5*e* and engaging holes 26 which engage the other short-edge wall portion 5*c*2 and the other case outer wall 20*b* correspond to the engaging-force-decreased portion of the invention; the second case-side hook portions 29 correspond to the rotation-restricting hook portion of the invention; and the engaging holes 5*g* which engage the second case-side hook portions 29 correspond to the rotation-restricting engaging hole.

Suppose that, in the electromagnetic contact device 1 also comprising the upper case 4 and extinction cover 5 with the above configuration, an anomalous large current flowed in the contact point portion 7 due to a short-circuit accident or similar, and the generated arc gas caused an excessive rise in the internal pressure in the extinction chamber S, so that the extinction cover 5 attempts to dissociate and rise up from the upper case 4.

In the extinction cover 5 of this embodiment, hook portions 5*e* engage with the engaging holes 26 in one of the case outer walls 20*a* on the side of one short-edge wall portion 5*c*1, and moreover engaging holes 5*g* and first case-side hook portions 28 on one of the case outer walls 20*a* are engaged; and hook portions 5*e* and engaging holes 26 in the other case outer wall 20*b* are engaged on the side of the other short-edge wall portion 5*c*2, but the second case-side hook portions 29 are arranged to provide a gap with the engaging holes 5*g* in a structure such that the latching force with the upper case 4 on the side of the other short-edge wall portion 5*c*2 is weaker than the latching force with the upper case 4 on the side of the one short-edge wall portion 5*c*1.

Figure 12:
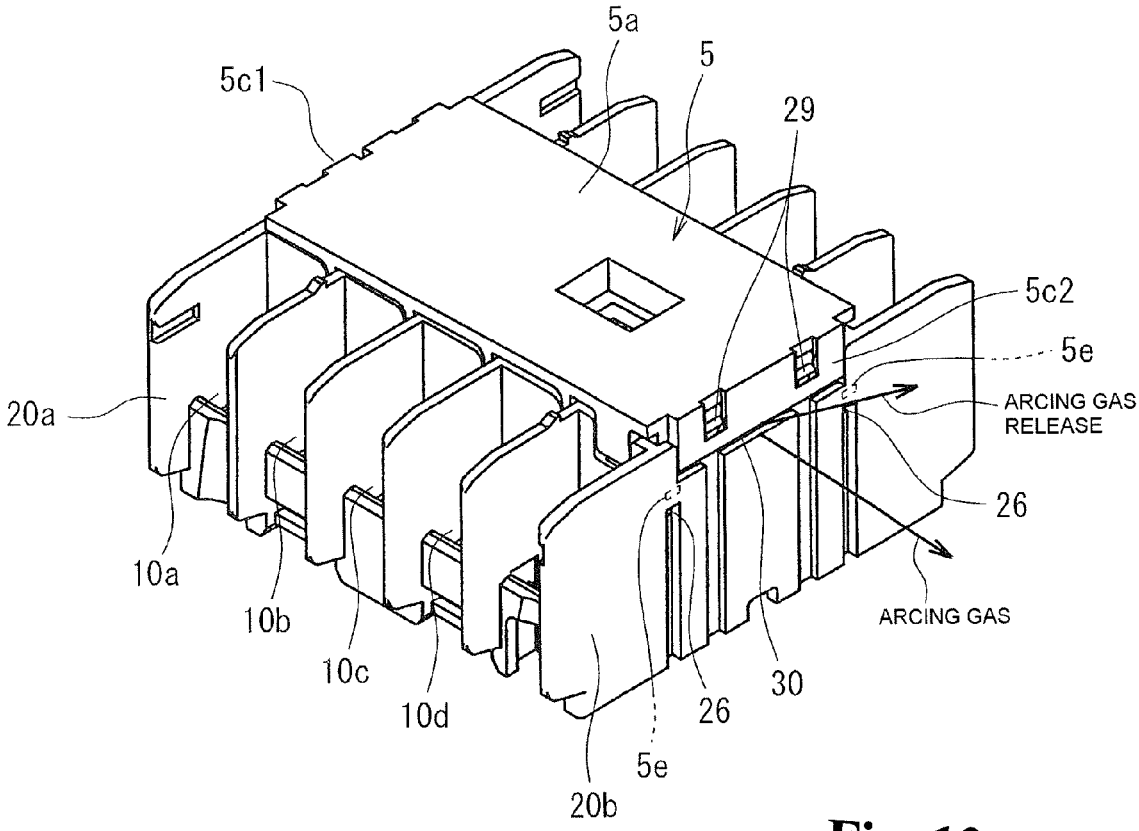
FIG. 12 shows a state in which the internal pressure in the extinction chamber has risen in the second embodiment.

For this reason, as shown in FIG. 12, when the internal pressure of the extinction chamber S rises excessively, the engaged state between the hook portions 5*e* on the side of the other short-edge wall portion 5*c*2 of the extinction cover 5 and the engaging holes 26 is disengaged before that the side of the one short-edge wall portion 5*c*1, and the side of the other short-edge wall portion 5*c*2 rises up.

When the other short-edge wall portion 5*c*2 rises up, the engaging holes 5*g* which had provided a gap with the second case-side hook portions 29 of the other case outer wall 20*b* are engaged with the second case-side hook portions 29, and so a gap 30 is formed between the lower-end face of the other short-edge wall portion 5*c*2 and the upper-end face of the case outer wall 20*b*, and this gap 30 serves as a gas escape hole so that arc gas within the extinction chamber S is released to the outside, the internal pressure of the extinction chamber S is reduced, and flying-off of the extinction cover 5 is prevented.

In this way, in the electromagnetic contact device 1 of this embodiment comprising the upper case 4 and extinction cover 5, a gas escape hole communicating between the extinction chamber S and the outside is not provided, so that in the case of normal operation slight amounts of dust cannot intrude into the extinction chamber S which is a sealed space, and erroneous operation of contact points of the contact point portion 7 can be reliably prevented, so that the reliability of contact of the contact point portion 7 can be enhanced.

Further, in this embodiment, the extinction cover 5 is mounted on the upper case 4 with strong latching force and weak latching force on the upper case 4, so that when arc gas causes the internal pressure of the extinction chamber S to rise excessively, the engaged state with weak latching force is disengaged first, and a gap 30 serving as a gas escape hole is formed, so that by reducing the internal pressure of the extinction chamber S, flying-off of the extinction cover 5 can be reliably prevented.

Also, the extinction cover 5 of this embodiment has a structure in which, by engagement of the second case-side hook portions 29 of the other case outer wall 20*b* and the engaging holes 5*g* in the other short-side wall portion 5*c*2, the side of the other short-edge wall portion 5*c*2 rises up slightly to the extent that a gap 30 serving as a gas escape hole is provided, and the extinction cover 5 is not damaged, so that component costs can be reduced.

In the electromagnetic contact devices of the above-described first and second embodiments, normally-open fixed contact points are formed on one of the tips of the contact point pieces 12 of the terminal portions 10*a*, 10*b*, and normally-closed contact points are formed on the other-side surface of the contact point pieces 12 of the terminal portions 10*c*, 10*d*; but this contact point configuration is one example, and in other contact point configurations, normally-open fixed contact points and normally-closed fixed contact points may be formed in the terminal portions 10*a* to 10*d*.

INDUSTRIAL APPLICABILITY

As explained above, an electromagnetic contact device of this invention is useful as a structure in which, by means of a sealed structure, the intrusion of fine dust is prevented and contact reliability of the contact point portion is increased, and in which even when arc gas is generated, flying-off of the extinction cover is prevented and gas escape is effected.

EXPLANATION OF REFERENCE NUMERALS

1 Electromagnetic contact device
3 Lower case
4 Upper case
5 Extinction cover
5*a* Cover body
5*b* Long-edge wall portion
5*c*1 One short-edge wall portion
5*c*2 Other short-edge wall portion
5*d* Engaging leg portion
5*e* Hook portion
5*f* Boss
5*g* Engaging hole
6 Terminal cover
7 Contact point portion
7*a* Movable contact point support
7*c* Movable contact point
9 Driving lever
10*a*-10*d* Terminal portion
11 Coil terminal
12 Contact point piece
13 Support partition wall
20*a* One case outer wall
20*b* Other case outer wall
21 Case partition wall
22*a*, 22*b* Main circuit terminal chamber
23*a*, 23*b* Coil terminal chamber
25 Boss hole
26 Engaging hole

27, 30 Gap
28 First case-side hook portion
29 Second case-side hook portion
S Extinction chamber

What is claimed is:

1. An electromagnetic contact device, comprising:

a case including an extinction chamber, and a contact point portion accommodated in the extinction chamber and having a movable contact point and a fixed contact point; and an extinction cover mated with and mounted on the case for covering the extinction chamber;

wherein the extinction cover is mounted on the case to seal the extinction chamber, the extinction cover has an engaging-force-increased portion strengthening an engaging force with the case, and an engaging-force-decreased portion weakening the engaging force with the case, said engaging-force-increased portion comprises two pairs of engaging portions and engaging holes engaging the engaging portions, respectively formed on one side of the extinction cover and the case, said engaging-force-decreased portion comprises one pair of engaging portion and engaging hole engaging the engaging portion, formed on a side opposite to the engaging portions and engaging holes, and in response to an increase in internal pressure in the extinction chamber due to an arc gas generation, the extinction cover disengages from the case at the engaging-force-disengaged portion and provides a gap with respect to the case linking the extinction chamber to external air, and the engaging-force-increased portion maintains engagement with the case.

2. The electromagnetic contact device according to claim 1, wherein the engaging-force-increased portion and the engaging-force-decreased portion comprise engaging hook portions disposed on one of the extinction cover or the case, and the engaging holes disposed on the other one of the extinction cover or the case to engage with the engaging hook portions.

3. The electromagnetic contact device according to claim 1, wherein the engaging-force-increased portion and the engaging-force-decreased portion are disposed in opposing corners of the extinction cover, and the engaging-force-increased portion has a rotational engaging portion joined with the case, said rotational engaging portion allowing the extension cover to disengage from the case at the engaging-force-decreased portion to rotate as a support point.

4. The electromagnetic contact device according to claim 1, wherein the engaging-force-decreased portion further comprises a rotation-restricting hook portion provided on one of the extinction cover or the case, and a rotation-restricting engaging hole provided on the other one of the extinction cover or the case to engage with the rotation-restricting hook portion when the extinction cover disengaging from the case rotates by a prescribed amount.

5. The electromagnetic contact device according to claim 1, wherein said engaging-force-increased portion further comprises a boss formed on the extinction cover, and a boss hole formed in the case and engaging the boss, said boss and the boss hole being arranged at said one side so that when the extinction cover disengages from the case at the engaging-force decreased portion, the extinction cover rotates at the boss.

6. The electromagnetic contact device according to claim 5, wherein each of the engaging portions of the engaging-force-increased portion and the engaging-force-decreased portions has an engaging leg portion extending downwardly from the extinction cover, and a hook portion formed at the engaging leg portion, and each of the engaging holes of the engaging-force-increased portion and the engaging-force-decreased portion is a hole formed in the case.

* * * * *